US005114174A

United States Patent [19]

Bogner

[11] Patent Number: 5,114,174

[45] Date of Patent: May 19, 1992

[54] BEARING ARRANGEMENT FOR THE LATERALLY MOVABLE VERTICAL SUPPORT OF A SKI BOOT ON A SKI

[75] Inventor: Martin Bogner, Ostfildern, Fed. Rep. of Germany

[73] Assignee: GEZE Sport International GmbH, Fed. Rep. of Germany

[21] Appl. No.: 658,674

[22] Filed: Feb. 21, 1991

[30] Foreign Application Priority Data

Mar. 17, 1990 [DE] Fed. Rep. of Germany ..... 4008677

[51] Int. Cl.[5] ..... A63C 9/00

[52] U.S. Cl. ..... 280/636; 280/629

[58] Field of Search ..... 280/636, 626, 628, 629

[56] References Cited

U.S. PATENT DOCUMENTS

| | | | |
|---|---|---|---|
| 3,544,123 | 12/1970 | Werner et al. | 280/636 |
| 4,398,747 | 8/1983 | Bernard et al. | 280/636 |
| 4,600,213 | 6/1986 | Sedlmair et al. | 280/636 |
| 4,804,202 | 2/1989 | Svoboda et al. | 280/636 |
| 4,889,359 | 12/1989 | Kowatsch et al. | 280/636 |

FOREIGN PATENT DOCUMENTS

| | | | |
|---|---|---|---|
| 1578818 | 12/1970 | Fed. Rep. of Germany . | |
| 2333166 | 2/1975 | Fed. Rep. of Germany . | |
| 2549203 | 6/1977 | Fed. Rep. of Germany | 280/636 |
| 3415272 | 10/1985 | Fed. Rep. of Germany . | |
| 2329309 | 5/1977 | France . | |

*Primary Examiner*—Andres Kashnikow
*Assistant Examiner*—Eric Culbreth
*Attorney, Agent, or Firm*—Evenson, Wands, Edwards, Lenahan & McKeown

[57] ABSTRACT

A ski binding is disclosed for supporting a ski boot in the downward direction by a plate-type bearing part which is arranged on a ski. The bearing support is supported at the ski so as to be displaceable in the transverse direction of the ski in response to predetermined forces during skiing. In the case of a displacement of the bearing support from a center position it takes up an increasing oblique position with a gradient in the displacement direction to thereby accommodate ski boot movements.

16 Claims, 3 Drawing Sheets

BEARING ARRANGEMENT FOR THE LATERALLY MOVABLE VERTICAL SUPPORT OF A SKI BOOT ON A SKI

BACKGROUND AND SUMMARY OF THE INVENTION

The invention relates to a bearing arrangement for the laterally movable vertical support of a ski boot on a ski, having a plate-type support part which can be slid to a limited extent relative to the ski in the direction of the transverse axis of the ski and on which the ski boot rests with its sole—particularly in the ball area of the sole.

Bearing arrangements of this type are known, for example, from the German Patent Document DE-OS 25 53 169. They have the object of reducing, as extensively as possible, the friction between the ski boot and the ski during relative movements between the ski boot and the ski in order to ensure as much as possible that the release action of the ski binding cannot be affected by friction when forces act sideways on the boot.

For this reason, a bearing of the support part is provided that has as little friction as possible, for example, according to the above-mentioned German Patent Document DE-OS 25 53 169 by means of balls.

However, it is not taken into account in this text that the support part can only have a limited mobility in the transverse direction of the ski if the support part is to be held on the ski or on a ski-side part so that it cannot be lost. Modern ski bindings now have a very wide elasticity range in the transverse direction of the ski; i.e., the ski binding is capable of restoring the ski boot into the normal position even if, because of laterally acting forces, it previously had been deflected relatively far out of the normal position. In this case, the elasticity range of the ski binding in the transverse direction of the ski may be larger than the moving range of the support part. This means, however, that the support part, when the ski boot is released sideways, can follow the ski boot only along a limited path in the transverse direction of the ski without the requirement of a relative movement between the ski boot and the support part. As soon as the support part has then reached its end position, the ski boot, in the case of a lateral release, still moves a certain distance farther along in the transverse direction of the ski until the release point of the ski binding is exceeded. In this movement phase of the ski boot, there is necessarily an increased amount of friction between the sole of the ski boot and the support part remaining in its end position. Should the ski boot sole now—for example, in the case of a forwardly directed lateral fall—be pressed on the support part with a higher force, the friction acting between the boot sole and the support part can assume considerable proportions so that the overall resistance which counteracts a release of the ski boot from the binding increases to an undesirable extent.

For this reason, bearing arrangements of the initially indicated type are questionable in the case of ski bindings with a high elasticity range in the transverse direction of the ski.

From the German Patent Document DE-OS 21 34 950, a bearing arrangement is known in which the support part is formed by an endless belt which winds movably around a ski-side support part and the upper portion of which, stretching over the top side of the support part in the transverse direction of the ski, is used as a bearing surface for the ski boot. The endless belt can therefore follow an arbitrary movements of the ski boot sole in the transverse direction of the ski. Thus the disadvantages of the initially mentioned bearing arrangement are avoided. However, it should be taken into account that the plastic material, from which the endless belt must be made in practice, can become rough after an extended use, particularly under the influence of UV-radiation which may be particularly intense in high mountain terrain. In this case, it should be taken into account that particularly skiers who are out of practice make relatively numerous pauses. In this case, the skis are often taken off so that the surrounding belts of the support arrangements are extensively exposed to the sun.

In addition, bearing arrangements are known which consist essentially of support plates with a very smooth top side which are fixed to the ski. As the material for these support plates, special plastics (teflon) are used which are relatively expensive and difficult to process. The fastening of these plastic plates on the ski normally takes place by glued connections which, however, withstand the UV-radiation only to a limited extent. The danger therefore exists that the support plates may be lost.

It is now an object of the invention to provide a bearing arrangement which, on the one hand, virtually requires no maintenance and is durable and, on the other hand, can practically not affect the release action of the ski binding.

By mean of a bearing arrangement of the initially mentioned type, this object is achieved in that it is provided according to the invention that the support part, with an increasing displacement in the direction of the transverse axis of the ski, takes up an increasingly oblique position with a gradient into the displacement direction.

Within the mobility range of the plate-shaped support part, the ski boot, which is supported on it, is disposed with an essentially negligible friction in the transverse direction of the ski. As soon as, during a lateral movement of the ski boot caused by forces acting from the outside, the support part pulled along by the ski boot sole reaches its end position assigned to the respective displacement direction, also in the case of a strong contact pressure of the ski boot sole on the support part, no increased resistance can occur which counteracts the lateral movement of the ski boot because the contact pressure forces acting between the ski boot sole and the support part, as a result of the oblique position of the support part, generate a force component seeks to move the ski boot from its normal or central position and thus continue the lateral displacement initiated by the ski boot.

In this case, it is advantageous for the zone in which the highest contact pressure forces occur between the plate-type support part and the ski boot sole, because of the oblique position of the support part, is situated on the side of the ski boot sole which is opposite the respective moving direction of the ski boot. Therefore, when the ski boot makes a more pronounced lateral movement, a torque is exercised on it which increases with the respective vertical stressing of the support part and which seeks to eject the ski boot sideways from the binding.

Therefore, by means of the arrangement according to the invention, it is reliably avoided that the resistances, which counteract a release movement of the ski boot, can rise to an undesirable extent shortly before the elasticity range of the binding is exceeded.

The principle according to the invention can be implemented in a constructively particularly simple manner. It is sufficient for sliding surfaces, which are sloped with respect to one another in the manner of a roof, to be arranged on the bottom side of the plate-shaped support part facing the top side of the ski and/or on the facing top side of a ski-side part, so that the respective side of the support part which points in the displacement direction, when the support part is displaced sideways, is moved sideways and diagonally downwards, and the other side is moved sideways and diagonally upwards.

Instead, it is also possible to construct the mentioned sliding surfaces in an arched manner.

In addition, it is expediently provided that the plate-type support part is equipped with a restoring spring assembly so that the support part always seeks to take up its normal or center position.

With respect to other preferred characteristics of the invention, reference is made to the claims as well as to the following explanation of particularly advantageous embodiments by means of the drawing.

Other objects, advantages and novel features of the present invention will become apparent from the following detailed description of the invention when considered in conjunction with the accompanying drawings.

DETAILED DESCRIPTION OF THE DRAWINGS

Figure 1:
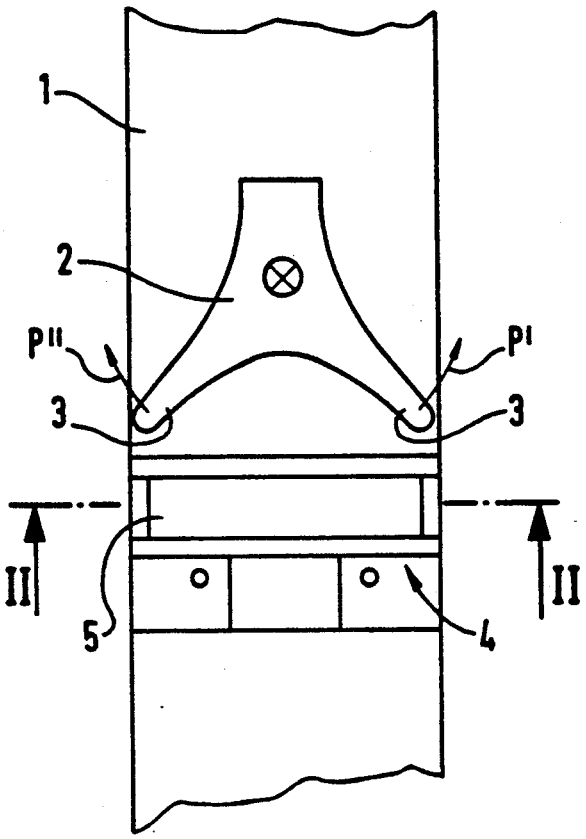
FIG. 1 is a schematic top partial view of a cutout of a ski with a front ski binding part and a bearing arrangement constructed according to a preferred embodiment of the invention.

According to FIG. 1, a basically known front binding part 2 of a ski binding is arranged on a ski i which, in the shown normal position, from the top and laterally reaches over the tip of the boot and the front end o the ski boot sole. The binding part 2 and its sole holder 3 may be deflected in the lateral direction corresponding to arrows P' and P'' against the force of a spring assembly, which is not visible, when correspondingly high forces in the transverse direction of the ski act upon the ski boot which is not shown. In this case, when the transverse forces diminish which act upon the ski boot, the binding part 2 and the sole holder 3 can restore the ski boot into the central or normal position if, during the deflection in the direction of the arrows P' and P'', an elasticity range is not exceeded which is determined by the construction of the binding part 2. When the elasticity range is exceeded, the boot is released.

The ball area of the sole of the ski boot is supported on a bearing arrangement 4 which has a plate type support part 5 which can be displaced in the transverse direction of the ski against a restoring spring, the sole of the ski boot resting on the support part 5.

During the lateral movement of the ski boot, the sole of the ski boot pulls the support part 5 along in the transverse direction of the ski until the support part 5 has in each case reached its end position on the right side or its end position on the left side of the ski.

If the support 5 is to be arranged on the ski 1 in a sufficiently secure manner and so that it cannot be lost, an only relatively limited displaceability can be ensured in the transverse direction of the ski by constructively simple devices. Here, in the case of modern binding parts 2, the range of the displaceability of the support part 5 in the transverse direction of the ski is less than the transverse displacement of the ski boot which is possible within the elasticity range of the binding part 2.

This has the result that, as a rule, the ski boot, in the case of a lateral release, before reaching the release point, must still pass through a residual distance in the transverse direction of the ski when the support part 5 has already reached its end position in the respective moving direction; i.e., a fairly large relative movement takes place between the sole of the ski boot and the support part 5 shortly before the release point is reached.

In order to avoid that this relative movement must take place against an undesirably high frictional resistance between the support part 5 and the ski boot sole, if the ball area of the ski boot is subjected to a higher load, the support part 5 must have a special construction according to the invention.

Figure 2:
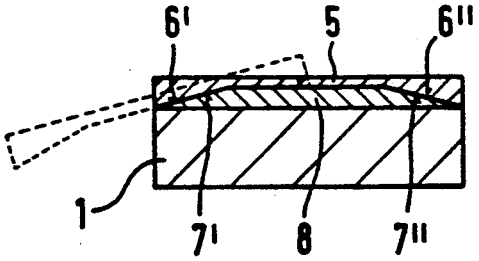
FIG. 2 is a schematic sectional view of the bearing arrangement corresponding to the intersecting line II—II in FIG. 1.

For this purpose reference is made to FIG. 2. On the bottom side of the support part 5, sliding surfaces 6' and 6'' are arranged which are sloped in the manner of a roof with respect to one another. The sliding surface 6' and 6'' rest in a slidably displaceable manner on correspondingly sloped opposing sliding surfaces 7' and 7'' of a bearing part 8 fixed to the ski when in the center position of the support part 5 illustrated in FIG. 2. The surfaces 6' and 7' or 6'' and 7'' each form oblique planes which each descend toward the adjacent longitudinal side of the ski.

This has the result that the support part 5, in the case of a lateral displacement, slopes increasingly in such a manner that the top side of the support part 5, which faces the ski boot sole, forms a diagonal surface which, when the lateral displacement of the support part 5 increases, descends increasingly toward the displacement direction. In FIG. 2, a corresponding position of the support part 5 is indicated by a dotted line.

If now the ski boot is forced downward in the direction of the vertical axis of the ski, in addition to a supporting force exercised by the support part 5 which acts in the direction of the vertical axis of the ski, a force component occurs which acts in the lateral direction and which seeks to push the ski boot o the top side of the support part in the gradient direction of the top side. As a result, the friction between the ski boot sole and the support part 5 is largely compensated.

In addition, the contact zone between the ski boot sole and the support part 5, in the case of its oblique position, is displaced in the direction of that of the lateral sole edge which, in each case, points in the upward direction of the gradient of the top side of the support part 5. As a result, the bottom side of the ski boot is supported asymmetrically with respect to the longitudinal axis of the ski boot in such a manner that a certain tilting momen is created which seeks to tilt the ski boot away toward the side in each case in the gradient direction of the top side of the support part. This effect promotes the compensation of the friction between the support part 5 and the ski boot sole.

Figure 3:
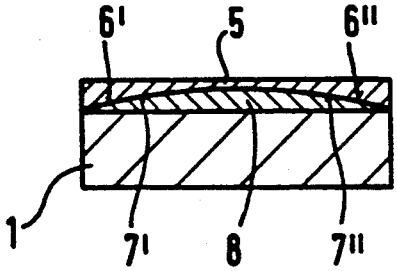
FIG. 3 is a sectional view of a modified embodiment corresponding to FIG. 2.

According to FIG. 3, the sliding surfaces 6' and 6'' as well as the opposing sliding surfaces 7' and 7'' may each also have an arched construction or may change into one another in a curved manner. Also in this case, the support part, in the case of a lateral displacement relative to the ski 1 takes up an increasingly oblique position in such a manner that the top side of the support part forms a ramp with a gradient in the transverse direction of the ski which supports the ski boot sole.

Deviating from the representation in FIGS. 2 and 3, the sliding surfaces 6' and 6'', on the one hand, and the opposing surfaces 7' and 7'', on the other hand, do not have to have a precisely diametrically opposed construction. One pair of surfaces respectively may also be replaced by narrow beads, rolls or the like.

Figure 4:
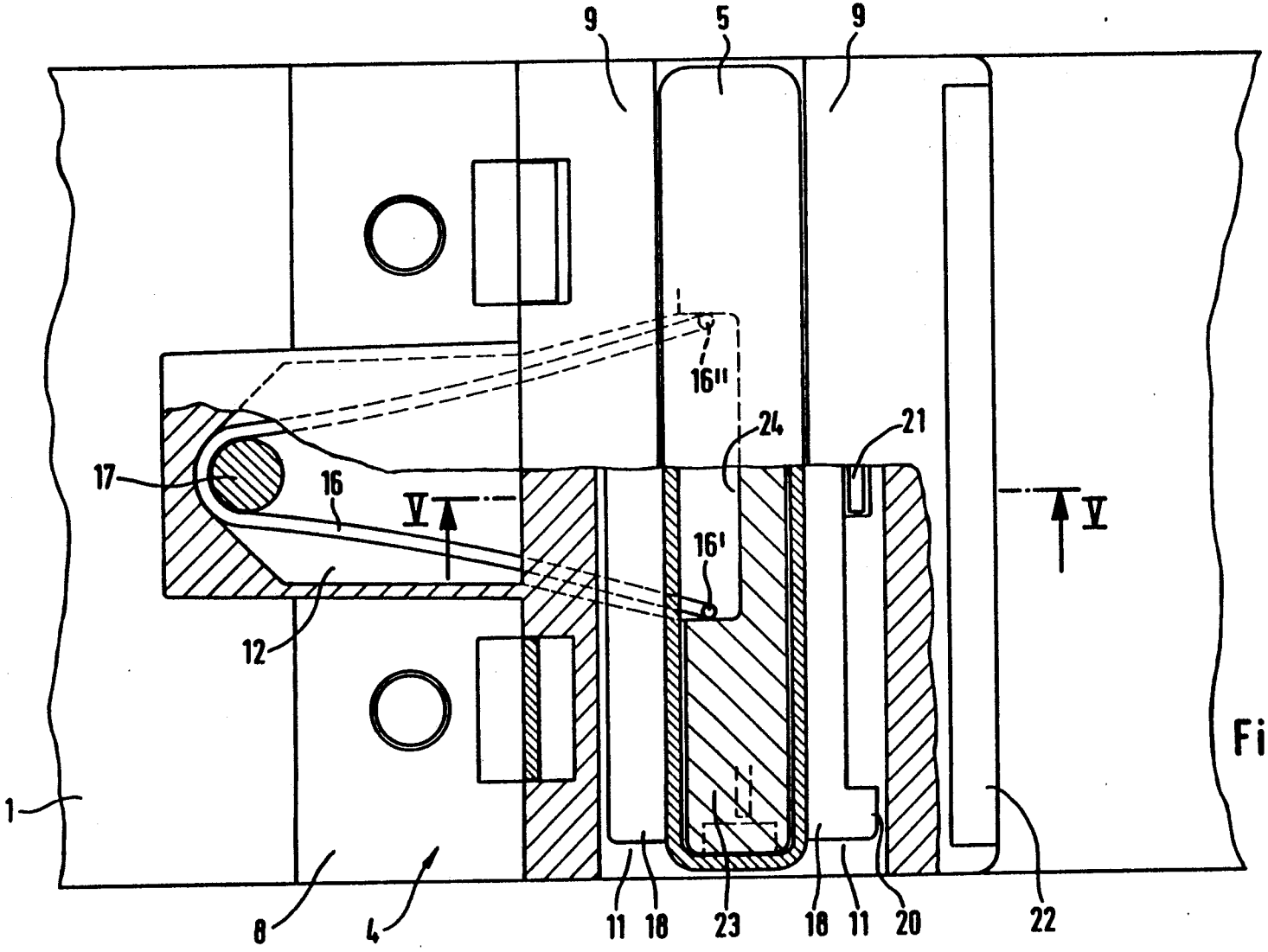
FIG. 4 is a partially horizontally sectioned top view of a bearing arrangement constructed according to a preferred embodiment of the invention.
Figure 5:
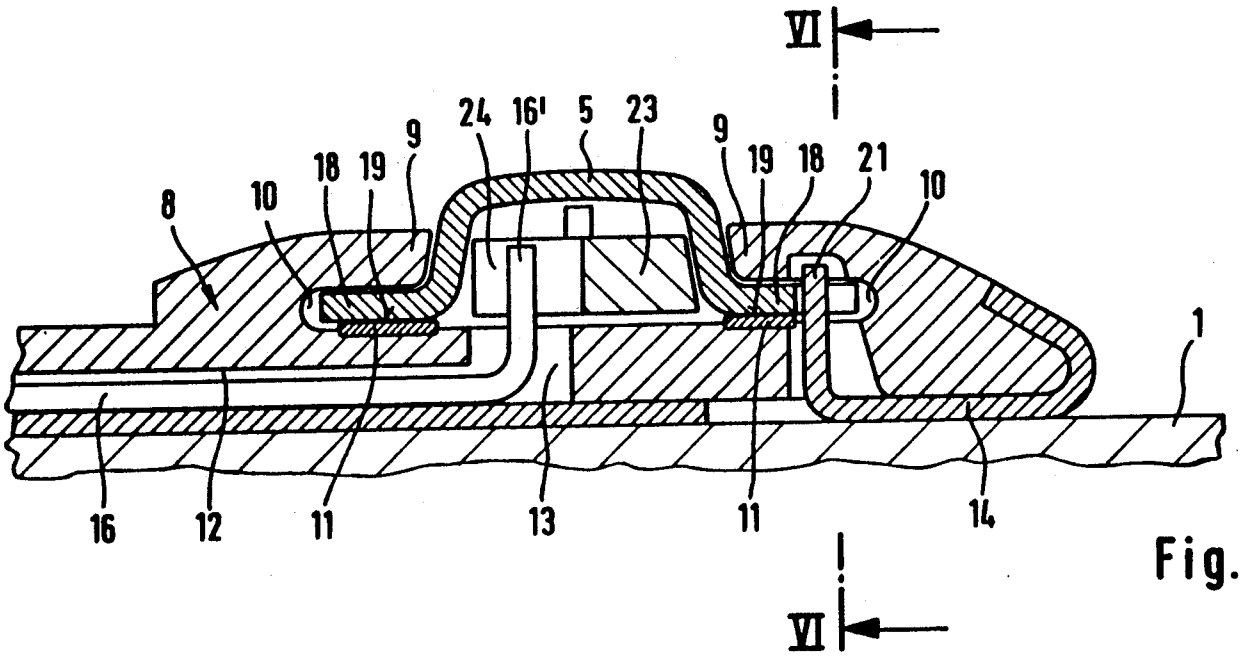
FIG. 5 is a sectional view corresponding to the intersecting line V—V in FIG. 4.
Figure 6:
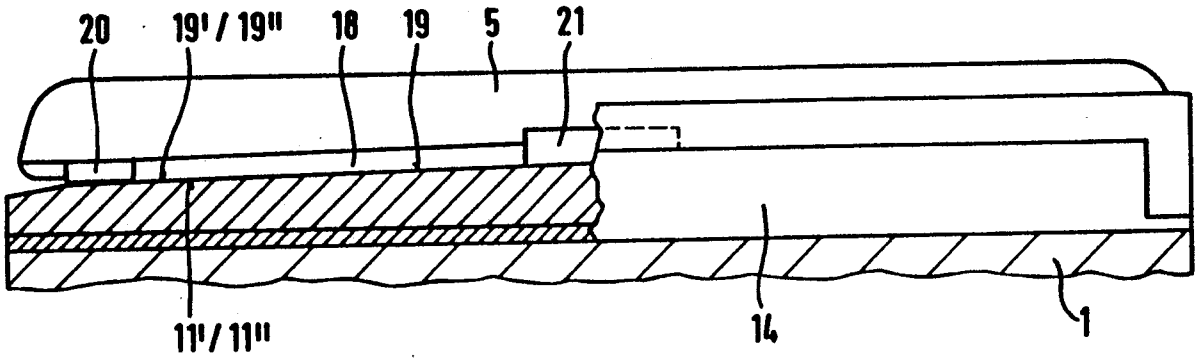
FIG. 6 is a sectional view corresponding to the intersecting line VI—VI in FIG. 5.

According to FIGS. 4 to 6, the essentially plate-type bearing part 8 is fixedly arranged on the ski on a holding sheet 14, two approximately horizontal webs 9 being arranged on the bearing part 8 which extend in the transverse direction of the ski and face one another. Slot-shaped ducts 10 are recessed below these webs 9 and extend in the transverse direction of the ski. Below the webs 9, the ducts 10 have sliding surfaces 11 which extend in the transverse direction of the ski and whose central areas, according to FIG. 5, extend in parallel to the top side of the ski 1 and whose end areas 11' and 11'' form oblique surfaces which descend in the direction to the respective adjacent longitudinal side of the ski.

On its side facing the holding sheet 14, the bearing part 8 has a flat indentation 12 which tunnels under one of the sliding surfaces 11 and changes into an opening 13 between the sliding surfaces 11.

Inside the indentation 12, which is closed off toward the bottom in the manner of a housing by the holding sheet 14, a leg spring 16 is received, the U-shaped center portion of which reaches around a pin 17 on the bearing part 8, and the free ends 16' and 16' of which are bent upwards inside the opening 13.

Between the webs 9, the support part 5 is arranged so that it can be displaced in the transverse direction of the ski. This support part 5 has an essentially plane top side which has edges which are rounded off in the manner of a cushion and extends slightly above that plane that is formed by the top sides of the webs 9 facing away from the top side of the ski.

Flanges 18 are molded onto the support part 5 which project into the ducts 10 and the bottom sides of which facing the sliding surfaces 11 are constructed as sliding surfaces 19 which are constructed essentially diametrically opposite the sliding surfaces 11. The sliding surfaces 19 therefore have end areas 19' and 19'' which are arranged diagonally corresponding to the end areas 11' and 11'' of the sliding surfaces 11.

Projections 20 are arranged on a flange 18 which, for limiting the displaceability of the support part 5, interact with a stop part 21 which, in turn, may be formed by an upwardly bent tongue of the holding sheet 14 holding the bearing part 18 and, from below, projects into a duct 10.

Between the flanges 18, a filler piece 23 is arranged in the support part 5 which has a recess 24 for receiving the bent ends 16' and 16'' of the leg spring 16.

The illustrated arrangement operates as follows:

In the shown center position of the support part 5, the ends 16' and 16'' of the leg spring 16 rests against the front faces of the recess 24, the legs of the leg spring 16, which are elastically spread apart, at the same time, resting flexibly against the opposite edges of the indentation 12. If the support part 5 is displaced in the transverse direction of the ski, for example, toward the left in FIG. 4, the left leg of the leg spring 16 continues to rest on the side of the indentation 12 which is on the left in FIG. 4, while the right leg is taken along toward the left by the support part 5. This generates a restoring force which acts upon the support part 5 and which seeks to hold the support part 5 in the shown center position.

In addition, the support part 5, by the interaction of the sliding surfaces 11 and 19 or of the end areas 11' and 11'' or 19' and 19'' with one another, takes up an increasingly oblique position during the displacement in the transverse direction of the ski, as was explained above by means of FIGS. 2 and 3

In the shown example, the support 5 with the flanges 18 may be constructed as a sheet metal part, while the bearing part 8 is formed by a plastic part, in which case the sliding surfaces 11 on the bearing-part-side may be provided with a particularly low-friction coating.

Other spring assemblies, such as coil springs, may be provided instead of the leg spring 16 according to other preferred embodiments of the invention.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A bearing arrangement for the laterally movable vertical support of a ski boot on a ski, comprising a bearing part disposed on top of the ski;

a ski boot support part disposed on top of the bearing part, said ski boot support part including an upwardly facing support surface for supporting a ball area of a ski boot sole, a guiding surface structure on a top surface of the bearing part;

and a counter guiding surface-structure on a bottom surface of the ski boot support part, wherein said guiding surface structure and said counter guiding surface structure are configured to engage one another and positively guide lateral movement of the ski boot support part such that the ski boot support part exhibits an increasing gradual controlled oblique position with a gradient in the displacement direction with an increasing displacement in the direction of the transverse-axis of the ski.

2. A bearing arrangement according to claim 1, wherein the ski boot support part is supported with respect to said bearing part so that it can be displaced against a slight friction,.

3. A bearing arrangement according to claim 2, wherein an elasticity range of the bearing arrangement is larger in the transverse direction of the ski than the moving range of the ski boot support part in the transverse direction of the ski.

4. A bearing arrangement according to claim 2, wherein, for the vertical support of the support part on the ski, ski-side supports interact with sliding supporting surfaces on the support part which are sloped with respect to one another in the shape of a roof with oppositely inclined sides at lateral sides thereof.

5. A bearing arrangement according to claim 4, wherein guiding surface structure is arched.

6. A bearing arrangement according to claim 4, wherein the ski boot support part is equipped with a restoring spring.

7. A bearing arrangement according to claim 1, wherein an elasticity range of the bearing arrangement is larger in the transverse direction of the ski than the moving range of the ski boot support part in the transverse direction of the ski.

8. A bearing arrangement according to claim 7, wherein, for the vertical support of the support part on the ski, ski-side supports interact with sliding supporting surfaces on the support part which are sloped with respect to one another in the shape of a roof with oppositely inclined sides at lateral sides thereof.

9. A bearing arrangement according to claim 1, wherein, for the vertical support of the support part on the ski, ski-side supports interact with sliding supporting surfaces on the support part which are sloped with respect to one another in the shape of a roof with oppositely inclined sides at lateral sides thereof.

10. A bearing arrangement according to claim 9, wherein the guiding surface structure is arched.

11. A bearing arrangement according to claim 9, wherein the ski boot support part is equipped with a restoring spring.

12. A bearing arrangement according to claim 1, wherein the ski boot support part is equipped with a restoring spring.

13. A bearing arrangement according to claim 1, wherein said guiding surface structure and counter guiding surface structure are inclined downwardly at both lateral edges to thereby effect the increasing oblique position of the support part during lateral displacements.

14. A bearing arrangement according to claim 13, wherein the ski boot support part is equipped with a restoring spring.

15. A bearing arrangement for the laterally movable vertical support of a ski boot on a ski, having a plate-type support part which can be slid to a limited extent relative to the ski in the direction o the transverse axis of the ski and on which the ski boot rests with a ball area of its sole, wherein the support part takes up an increasing oblique position with a gradient in the displacement direction with an increasing displacement in the direction of the transverse axis of the ski, and wherein the support part includes a bottom surface which is slidably disposed on top of a top surface of a ski side support surface, said bottom surface and top surface being inclined downwardly at both lateral edges to thereby effect the increasing oblique position of the support part during lateral displacements.

16. A bearing arrangement according to claim 15, wherein the support is equipped with a restoring spring.

* * * * *